US009988728B2

(12) United States Patent
Gonzalez Olguin et al.

(10) Patent No.: US 9,988,728 B2
(45) **Date of Patent: *Jun. 5, 2018**

(54) ANODE ASSEMBLY, SYSTEM INCLUDING THE ASSEMBLY, AND METHOD OF USING SAME

(71) Applicant: FREEPORT MINERALS CORPORATION, Phoenix, AZ (US)

(72) Inventors: Luis A. Gonzalez Olguin, Calama (CL); Rafael Garcia Navarro, Silver City, NM (US); Luis Ricardo Olivares, Calama (CL); Larry R. Todd, Calama (CL); Ron Haines, Willoughby, OH (US); Chris Zanotti, North Royalton, OH (US); Casey J. Clayton, Calama (CL); Mark Peabody, Morenci, AZ (US); Scot P. Sandoval, Morenci, AZ (US)

(73) Assignee: FREEPORT MINERALS CORPORATION, Phoenix, AZ (US)

( * ) Notice: Subject to any disclaimer, the term of this patent is extended or adjusted under 35 U.S.C. 154(b) by 161 days.

This patent is subject to a terminal disclaimer.

(21) Appl. No.: 14/874,220

(22) Filed: Oct. 2, 2015

(65) Prior Publication Data

US 2016/0047055 A1 Feb. 18, 2016

Related U.S. Application Data

(63) Continuation of application No. 13/028,983, filed on Feb. 16, 2011, now Pat. No. 9,150,974.

(51) Int. Cl.
*C25C 7/00* (2006.01)
*C25C 7/02* (2006.01)
(Continued)

(52) U.S. Cl.
CPC ..... *C25C 7/02* (2013.01); *C25C 7/04* (2013.01); *C25C 1/02* (2013.01); *C25C 1/08* (2013.01);
(Continued)

(58) Field of Classification Search
CPC ..... C25C 7/02–7/7025; E04H 17/12–17/1439
See application file for complete search history.

(56) References Cited

U.S. PATENT DOCUMENTS 460,218 A * 9/1891 Riggs ..... A01M 1/04 245/8
2,841,415 A * 7/1958 Black ..... B62D 25/2054 280/149.2
(Continued)

FOREIGN PATENT DOCUMENTS

EP 0534011 3/1993
WO WO 2004050958 6/2004

OTHER PUBLICATIONS

Dictionary.com (Tab, http://www.dictionary.com/browse/tab?s=t).*
(Continued)

*Primary Examiner* — Luan V Van
*Assistant Examiner* — Alexander W Keeling
(74) *Attorney, Agent, or Firm* — Snell & Wilmer L.L.P.

(57) ABSTRACT

The present invention relates to an anode assembly for use in an electrolytic cell for recovery of metal. The assembly includes a hanger bar, a first perimeter bar, a second perimeter bar, optionally one or more center conductor bars, a base bar, a first tab coupled to the first perimeter bar and/or the base bar, and a second tab coupled to the second perimeter bar and/or the base bar. The assembly may also include insulating separators coupled to the tabs and/or insulators coupled to an active area of the anode assembly. A system includes the anode assembly, a cathode assembly, and a tank.

18 Claims, 6 Drawing Sheets

(51) Int. Cl.

| | |
|---|---|
| ***C25C 7/04*** | (2006.01) |
| *C25C 1/22* | (2006.01) |
| *C25C 1/10* | (2006.01) |
| *C25C 1/08* | (2006.01) |
| *C25C 1/02* | (2006.01) |
| *C25C 1/12* | (2006.01) |

(52) U.S. Cl.
CPC ..... *C25C 1/10* (2013.01); *C25C 1/12* (2013.01); *C25C 1/22* (2013.01)

(56) References Cited

U.S. PATENT DOCUMENTS

| | | | |
|---|---|---|---|
| 3,979,275 | A | 9/1976 | Harvey et al. |
| 3,997,421 | A | 12/1976 | Perri et al. |
| 4,035,280 | A | 7/1977 | Deane et al. |
| 4,100,042 | A | 7/1978 | Wojcik et al. |
| 4,129,494 | A | 12/1978 | Norman |
| 4,134,806 | A | 1/1979 | De Nora et al. |
| 4,211,629 | A | 7/1980 | McCutchen et al. |
| 4,460,450 | A | 7/1984 | Koziol et al. |
| 4,481,097 | A | 11/1984 | Asano et al. |
| 4,606,804 | A | 8/1986 | Schulke et al. |
| 4,619,751 | A | 10/1986 | Robinson |
| 4,642,173 | A | 2/1987 | Koziol et al. |
| 5,492,608 | A | 2/1996 | Sandoval et al. |
| 5,679,240 | A | 10/1997 | Anastasijevic et al. |
| 6,017,428 | A | 1/2000 | Hill et al. |
| 6,129,822 | A | 10/2000 | Ferdman |
| 6,139,705 | A | 10/2000 | Brown, Jr. et al. |
| 6,287,433 | B1 | 9/2001 | Sapozhnikova |
| 6,352,622 | B1 | 3/2002 | Brown et al. |
| 6,483,036 | B1 | 11/2002 | Santoyo |
| 7,368,049 | B2 | 5/2008 | Sandoval et al. |
| 7,378,010 | B2 | 5/2008 | Stevens et al. |
| 7,393,438 | B2 | 7/2008 | Marsden et al. |
| 7,452,455 | B2 | 11/2008 | Sandoval et al. |
| 7,494,580 | B2 | 2/2009 | Sandoval et al. |
| 7,591,934 | B2 | 9/2009 | Marsden et al. |
| 7,736,475 | B2 | 6/2010 | Sandoval et al. |
| 7,736,476 | B2 | 6/2010 | Gilbert et al. |
| 7,736,486 | B2 | 6/2010 | Stevens et al. |
| 7,988,837 | B2 | 8/2011 | Aylwin et al. |
| 7,993,501 | B2 | 8/2011 | Ashford et al. |
| 8,022,004 | B2 | 9/2011 | Sandoval et al. |
| 8,038,855 | B2 | 10/2011 | Sandoval et al. |
| 8,124,556 | B2 | 2/2012 | Sandoval et al. |
| 9,150,974 | B2 * | 10/2015 | Gonzalez Olguin ..... C25C 7/02 |
| 2002/0095840 | A1 * | 7/2002 | Seiber ..... G09F 7/18 40/606.15 |
| 2004/0051290 | A1 * | 3/2004 | Morgan ..... B60R 9/06 280/769 |
| 2004/0074766 | A1 | 4/2004 | Ebert |
| 2005/0023151 | A1 | 2/2005 | Sandoval et al. |
| 2005/0265035 | A1 * | 12/2005 | Brass ..... F21L 4/00 362/451 |
| 2007/0001432 | A1 * | 1/2007 | Thurm ..... B60P 3/07 280/656 |
| 2009/0164234 | A1 * | 6/2009 | Sinn ..... A01K 29/00 705/330 |
| 2009/0288856 | A1 * | 11/2009 | Sandoval ..... C23C 18/1216 174/126.2 |
| 2012/0018300 | A1 | 1/2012 | Sandoval et al. |

OTHER PUBLICATIONS

Merriam-Webster (Bracket, https://www.merriam-webster.com/dictionary/bracket).*

Sandoval et al., Development and Commercialization of an Alternative Anode for Copper Electrowinning, Proceedings of Cu 2010, pp. 1-12, Freeport-McMoRan Mining Company, Morenci, AZ, USA.

Notice of Allowance from U.S. Appl. No. 13/028,983, dated Sep. 14, 2012.

Non-Final Office Action from U.S. Appl. No. 13/028,983, dated May 22, 2014.

Final Office Action from U.S. Appl. No. 13/028,983, dated Jan. 15, 2015.

Dictionary.com, "Coupled", Jan. 6, 2015.

Notice of Allowance from U.S. Appl. No. 13/028,983 dated Jun. 8, 2015.

International Search Report and Written Opinion from corresponding International Application No. PCT/US2012/023589, dated Nov. 15, 2012.

International Preliminary Report on Patentability from corresponding International Application No. PCT/US2012/023589, dated Jul. 3, 2013.

Examination Report dated Feb. 9, 2017 in corresponding Chilean Patent Application No. 2365-2013 and machine translation of same in English.

Examination Report dated Aug. 4, 2016 in corresponding Chilean Patent Application No. 2365-2013 and machine translation of same in English.

* cited by examiner

ANODE ASSEMBLY, SYSTEM INCLUDING THE ASSEMBLY, AND METHOD OF USING SAME

CROSS REFERENCE TO RELATED APPLICATIONS

This application is a continuation application of and claims priority to U.S. patent application Ser. No. 13/028,983, entitled "ANODE ASSEMBLY, SYSTEM INCLUDING THE ASSEMBLY, AND METHOD OF USING SAME," which was filed Feb. 16, 2011. The aforementioned application is hereby incorporated by reference herein in its entirety.

FIELD OF INVENTION

The present invention relates, generally, to an anode assembly for an electrolytic cell and to a system including the assembly. More particularly, the invention relates to an anode assembly for use in an electrolytic metal recovery system.

BACKGROUND OF THE INVENTION

Electrowinning and electrorefining are often used in hydrometallurgical processing of ore to recover metal, such as copper, silver, platinum group metals, molybdenum, zinc, nickel, cobalt, uranium, rhenium, rare earth metals, combinations thereof, and the like from ore. The recovery of metal from ore often includes exposing the ore to a leaching process (e.g., atmospheric leaching, pressure leaching, agitation leaching, heap leaching, stockpile leaching, thin-layer leaching, vat leaching, or the like) to obtain a pregnant leach solution including desired metal ions, optionally, purifying and concentrating the pregnant leach solution, using, e.g., a solvent extraction process, and then recovering the metal, using, the electrowinning and/or electrorefining process.

A typical electrolytic cell for electrowinning and/or electrorefining includes a tank, an anode assembly, a cathode assembly that is spaced apart from the anode assembly, and an electrolyte solution between an active portion of the anode assembly and an active portion of the cathode assembly and contained within the tank. In the case of electrowinning, metal is recovered from the solution by applying a bias across the cathode assembly and the anode assembly sufficient to cause the metal ions in solution to reduce onto an active area of the cathode assembly. In the case of electrorefining, the anode includes a relatively impure metal, and upon application of a sufficient bias between the anode assembly and the cathode assembly, a portion of the anode dissolves in the electrolyte and refined metal from the anode is deposited onto the active area of the cathode assembly.

FIG. 1 illustrates an anode assembly 100 for use in an electrolytic cell designed to recover metal from solution. Assembly 100 includes a hanger bar 110, conductor bars or rods 120, and active substrates 130. Hanger bar 110 is designed to connect to a power source (not illustrated), and connector bars 120 and active substrates 130 are electrically coupled to hanger bar 110 to provide a desired current and voltage to active surface 130.

Anode assembly 100 may work well for a variety of applications. However, assembly 100 may be susceptible to bending, which may affect an acceptable spacing between assembly 100 and a cathode assembly. In addition, the edges of surfaces 130 may become frayed or bent and thus susceptible to shorting. Accordingly, improved anode assemblies, systems including the assemblies, and methods of using the assemblies and systems are desired.

SUMMARY OF THE INVENTION

The present invention generally relates to an anode assembly for use in an electrolytic cell and to a system including the assembly. The anode assembly can be used in an electrolytic system to recover or refine metal(s), such as copper, gold, silver, zinc, platinum group metals, nickel, chromium, cobalt, manganese, molybdenum, rhenium, uranium, rare earth metals, alkali metals, alkaline metals, and the like. While the ways in which the present invention addresses the drawbacks of the prior art are discussed in greater detail below, in general, the anode assembly is configured to, relative to conventional assemblies, reduce bending of the assembly, provide insulating spacers to facilitate consistent spacing between the anode assembly and a cathode assembly, and to reduce shorts that would otherwise result from frayed or bent edges of a conductive surface of the anode assembly.

In accordance with various embodiments of the invention, an anode assembly includes a hanger bar, a conductor bar coupled to the hanger bar, a base bar coupled to the conductor bar, a first perimeter bar coupled to the hanger bar, a second perimeter bar coupled to the hanger bar, and an active surface having a first edge portion and a second edge portion, the first edge portion coupled to the first perimeter bar and the second edge portion coupled to the second perimeter bar. The assembly base bar and the perimeter bars reduce the tendency of the assembly to bend and therefore, among other things, allow for closer and more consistent spacing between the anode assembly and a cathode assembly. In addition, because the perimeter bars are coupled to edge portions of the active surface, an amount of fraying or bending at the edge or perimeter of the active surface is reduced. In accordance with various aspects of these embodiments, the assemblies further include insulating spacers. In accordance with further aspects, the assemblies include a first tab coupled to the first perimeter bar and/or the base bar, a second tab coupled to the second perimeter bar and/or the base bar, and the insulating spacers are coupled to the respective tabs. Use of the insulating spacers allows for more consistent spacing between the anode assembly and a cathode assembly and therefore, facilitates more even plating on the cathode and allows for closer spacing between the anode assembly and the cathode assembly, which in turn allows for lower voltage and power requirements to plate a desired amount of material onto the cathode assembly. In accordance with yet further aspects of these embodiments, an assembly includes one or more insulators over a portion of the active surface. The insulators mitigate any short circuits to the active surface and thereby increase the lifetime of the active surface.

In accordance with additional embodiments of the invention, an anode assembly includes a hanger bar, a first perimeter bar coupled to the hanger bar, a second perimeter bar coupled to the hanger bar, a first tab coupled to the first perimeter bar, a second tab coupled to the second perimeter bar, and a base bar coupled to the first tab and the second tab. In accordance with various aspects of these embodiments, the assembly further includes one or more conductor bars coupled to the hanger bar and the base bar. In accordance with yet additional aspects, the assembly also includes insulating separators coupled to the first tab and the second tab. In accordance with various exemplary aspects of these embodiments, the insulating separators include braces configured to couple (e.g., removably) to respective tabs. And, in accordance with yet further aspects of these embodiments, an assembly includes one or more insulators over a portion of the active surface.

In accordance with yet further embodiments of the invention, a system for plating metal onto an active area of a cathode includes a tank, a cathode assembly having a cathode active area, and an anode assembly spaced apart from the cathode assembly, wherein the anode assembly includes a hanger bar, a first perimeter bar coupled to the hanger bar, a second perimeter bar coupled to the hanger bar, a base bar, a first tab coupled to the first perimeter bar and/or the base bar, a second tab coupled to the second perimeter bar and/or the base bar. The anode assembly may additionally include insulating spacers coupled to the tabs. In accordance with alternative embodiments of the invention, a system for recovering metal includes a tank, a cathode assembly, and an anode assembly spaced apart from the cathode assembly, wherein the anode assembly includes a hanger bar, a conductor bar coupled to the hanger bar, a base bar coupled to the conductor bar, a first perimeter bar coupled to the hanger bar, a second perimeter bar coupled to the hanger bar, and an active surface having a first edge portion and a second edge portion, the first edge portion coupled to the first perimeter bar and the second edge portion coupled to the second perimeter bar. The assembly may additionally include tabs coupled to the perimeter bars and/or the base bar and may further include insulating spacers coupled to the tabs. The anode assembly may additionally or alternatively include one or more insulators coupled to the active surface.

In accordance with yet additional embodiments of the invention, a method of using an anode assembly comprises providing an anode assembly including a hanger bar, a first perimeter bar coupled to the hanger bar, a second perimeter bar coupled to the hanger bar, a base bar, a first tab coupled to the first perimeter bar and/or the base bar, a second tab coupled to the second perimeter bar and/or the base bar, providing a cathode assembly, providing an electrolyte, and applying a sufficient bias across the cathode assembly and the anode assembly to cause current to flow from the anode assembly to the cathode assembly and cause metal ions to reduce onto an active area of the cathode assembly. In accordance with various aspects of these embodiments, the anode assembly includes insulating spacers coupled to the first and second tabs and/or one or more insulators coupled to an active area of the anode assembly. In accordance with additional embodiments, a method of using an anode assembly comprises providing an anode assembly including a hanger bar, a conductor bar coupled to the hanger bar, a base bar coupled to the conductor bar, a first perimeter bar coupled to the hanger bar, a second perimeter bar coupled to the hanger bar, and an active surface having a first edge portion and a second edge portion, the first edge portion coupled to the first perimeter bar and the second edge portion coupled to the second perimeter bar, providing a cathode assembly, providing an electrolyte, and applying a sufficient bias across the cathode assembly and the anode assembly to cause current to flow from the anode assembly to the cathode assembly and cause metal ions to reduce onto an active area of the cathode assembly. In accordance with various aspects of these embodiments, the anode assembly includes tabs coupled to the perimeter bars and/or the base bar, insulating spacers coupled to the tabs and/or one or more insulators coupled to an active area of the anode assembly.

These and other features and advantages of the present invention will become apparent upon a reading of the following detailed description when taken in conjunction with the drawing figures, wherein there is shown and described various illustrative embodiments of the invention.

BRIEF DESCRIPTION OF THE DRAWING FIGURES

The exemplary embodiments of the present invention will be described in connection with the appended drawing figures in which like numerals denote like elements and:

Figure 4A:
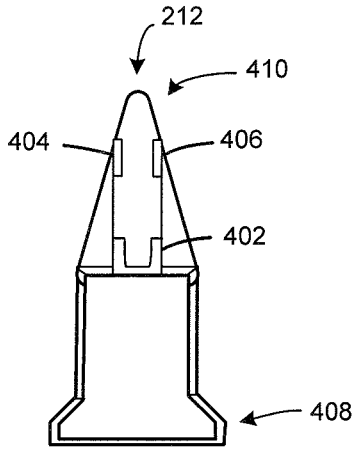
Figure 4B:
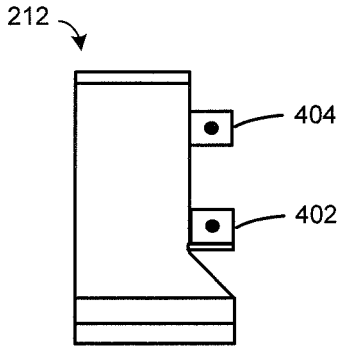
Figure 4C:
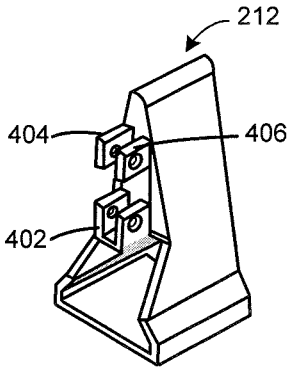
Figure 5:
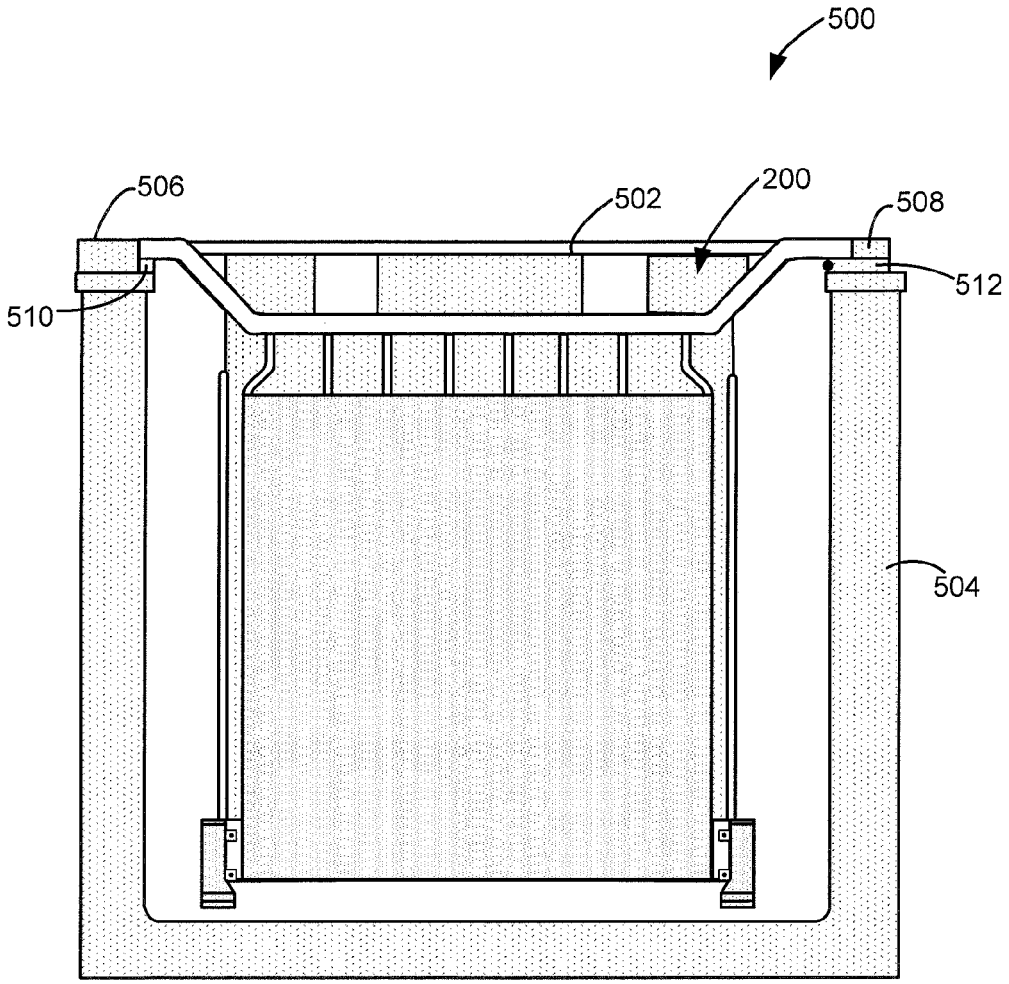
Figure 6:
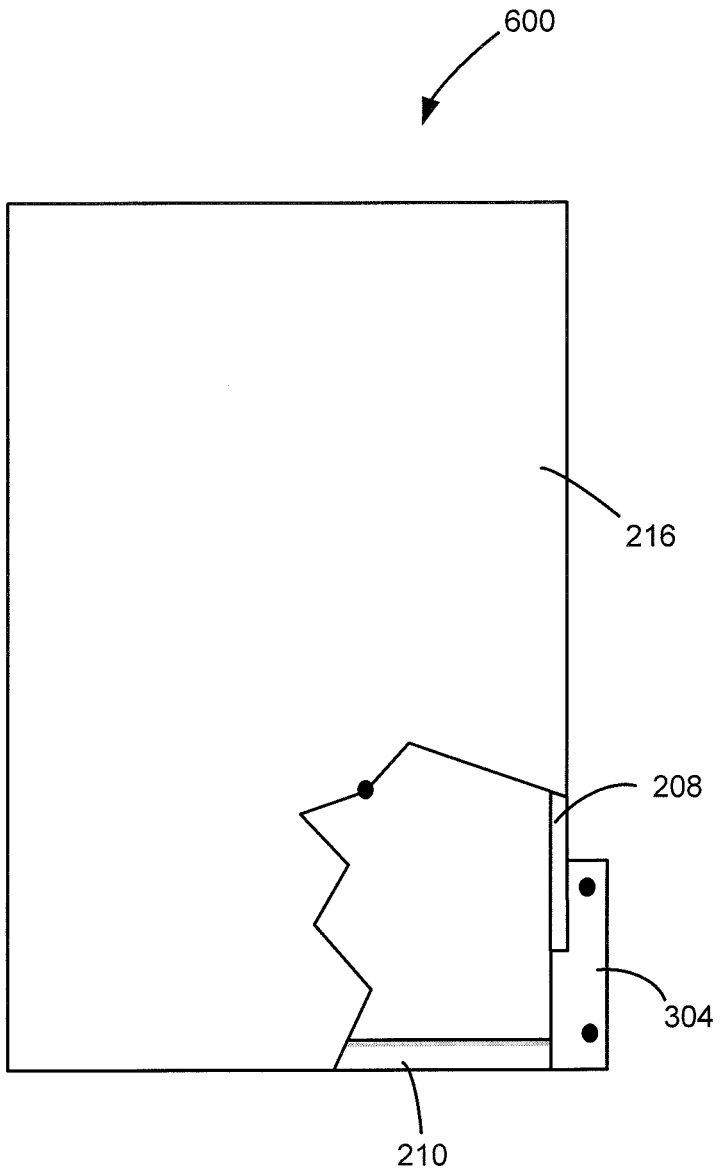

FIGS. 4*a*, 4*b*, and 4*c* illustrate an insulating separator in accordance with various exemplary embodiments of the invention;

FIG. 5 illustrates a cut-away view of a portion of a system for recovering metal in accordance with exemplary embodiments of the invention; and FIG. 6 illustrates a portion of an anode assembly in accordance with additional embodiments of the invention.

It will be appreciated that elements in the figures are illustrated for simplicity and clarity and have not necessarily been drawn to scale. For example, the dimensions of some of the elements in the figures may be exaggerated relative to other elements to help to improve understanding of illustrated embodiments of the present invention.

DETAILED DESCRIPTION OF THE INVENTION

The description of exemplary embodiments of the present invention provided below is merely exemplary and is intended for purposes of illustration only; the following description is not intended to limit the scope of the invention disclosed herein. Moreover, recitation of multiple embodiments having stated features is not intended to exclude other embodiments having additional features or other embodiments incorporating different combinations of the stated features.

The present invention provides an improved anode assembly and portions thereof for use in an electrolytic metal recovery process. As set forth in more detail below, the anode assembly of the present invention provides increased stiffness to the assembly, reduces edge fraying or bending, and allows for more even and reliable spacing between the anode assembly and a cathode assembly, which can lead to more efficient (e.g., reduced voltage and power requirements for an amount of plated material) and consistent plating of the metal onto the cathode. Thus, the anode assembly of the present invention can be used where reduced spacing between and anode assembly and cathode assembly and/or more consistent spacing between the anode assembly and cathode assembly are desired. In addition, the assembly in accordance with various embodiments does not require edge insulating strips along a perimeter of an active area and thus, for a given active area, the assembly of the present invention has a larger effective active area compared to an assembly that includes such edge strips.

The anode assembly and portions thereof described herein can be used in a variety of electrowinning applications for various metals. For convenience, the anode assembly and portions are described below in connection with electrowinning metal from solution. The assembly can be used to recover, for example, metals such as copper, gold, silver, zinc, platinum group metals, nickel, chromium, cobalt, manganese, molybdenum, rhenium, uranium, rare earth metals, alkali metals, alkaline metals, and the like. By way of particular example, the anode assembly of the present invention may be used in connection with recovery of copper from hydrometallurgical processing of copper sulfide ores and/or copper oxide ores.

Figure 1:
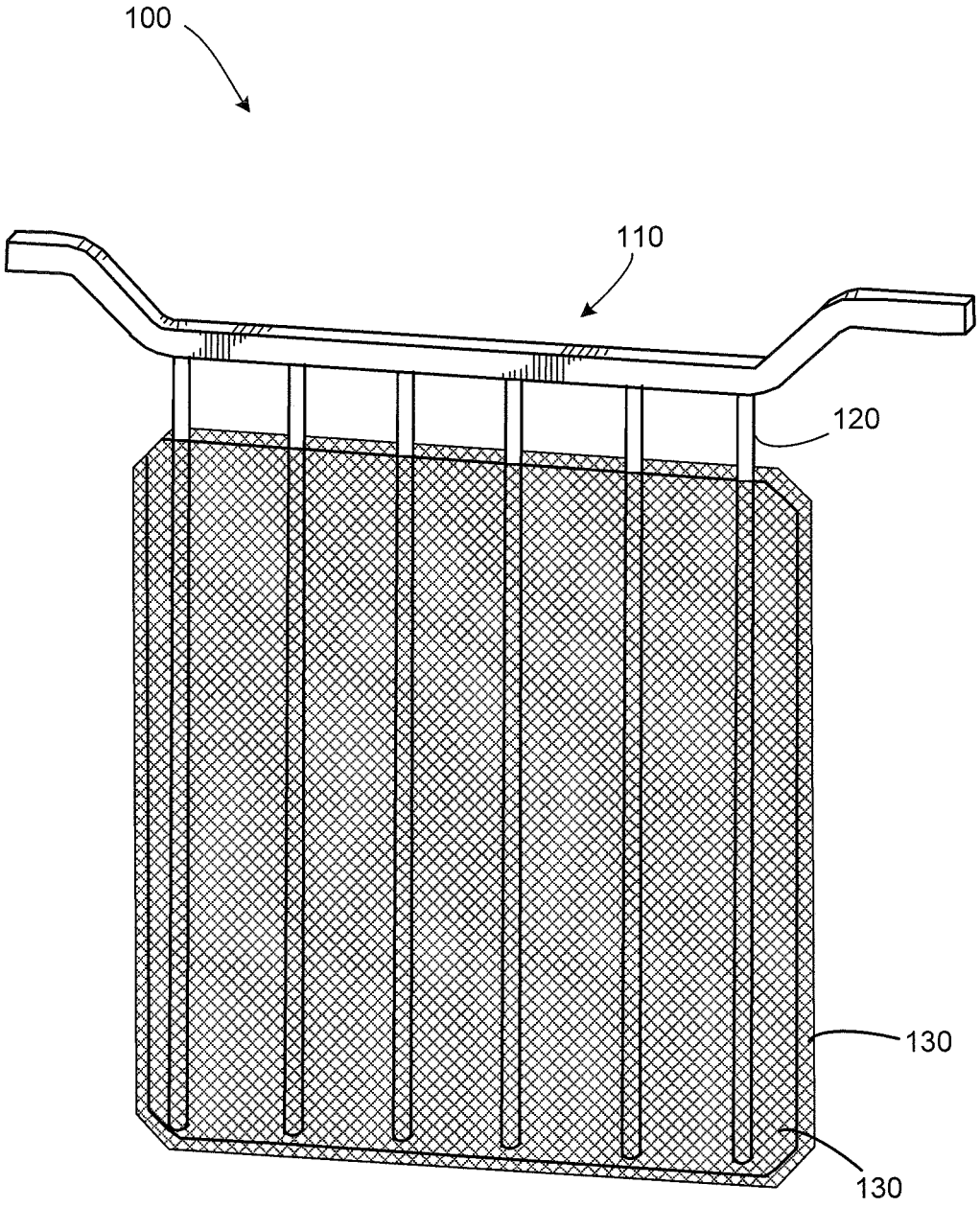
FIG. 1 (Prior Art)
FIG. 1 illustrates an anode assembly as known in the art.
Figure 2:
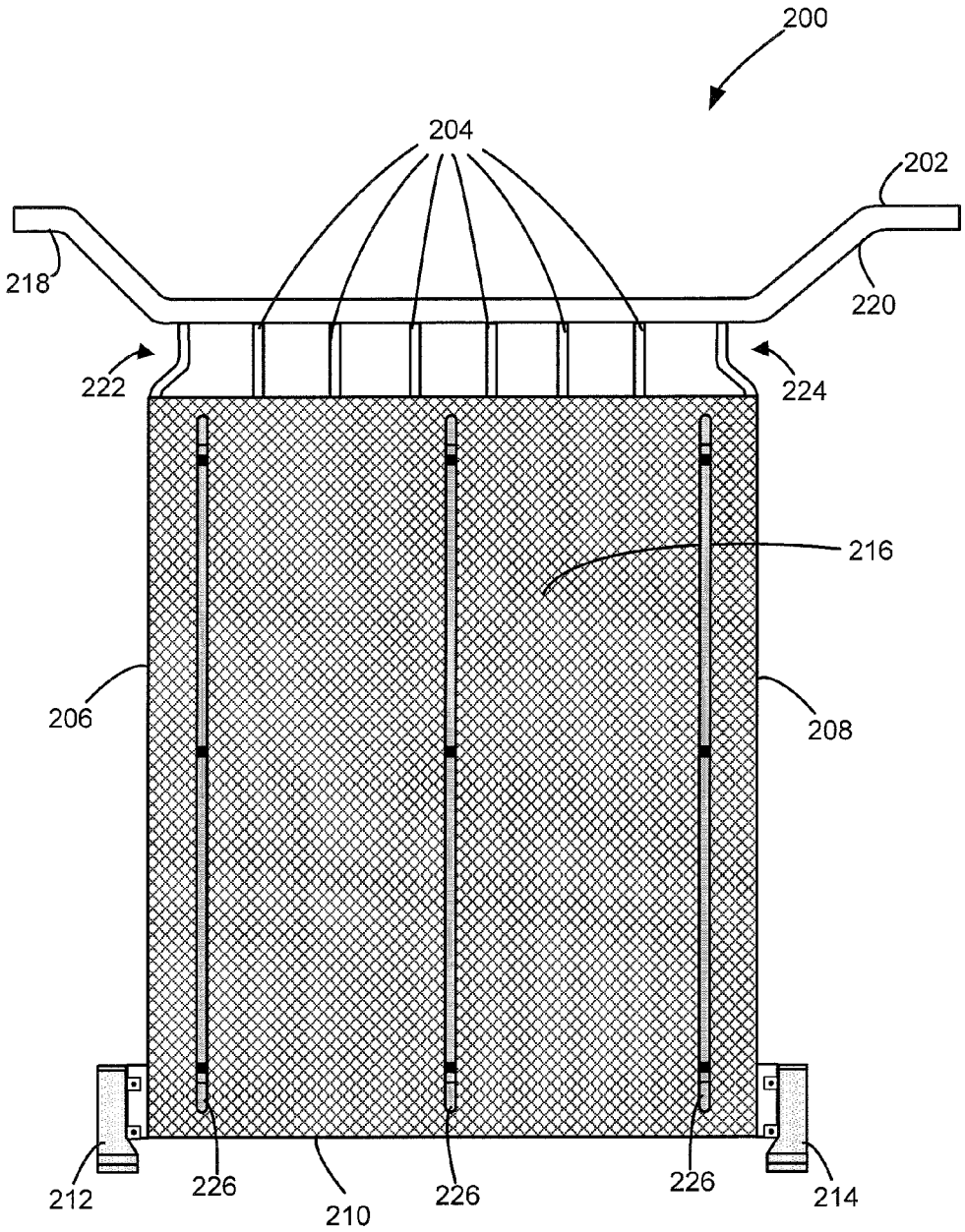
FIG. 2 illustrates an anode assembly in accordance with various embodiments of the invention.

FIG. 2 schematically illustrates an anode assembly 200 in accordance with various embodiments of the invention. In the illustrated example, assembly 200 includes a hanger bar 202, one or more center conductor bars 204, a first perimeter bar 206, a second perimeter bar 208, a base bar 210, a first insulating separator 212, a second insulating separator 214, and at least one active substrate or surface 216. Assembly 200 may also optionally include one or more insulators 226, and, as set forth in more detail below, assembly 200 may also include a second active substrate (not shown) on an opposite side of bars 204 relative to illustrated substrate 216.

Hanger bar 202 is designed to form electrical contact with bus bars of a plating system, e.g., bus bars 510, 512, illustrated in FIG. 5, discussed in more detail below. Hanger bar 202 may be formed of a variety of materials such as copper, copper alloy, copper aluminum alloys, stainless steel, titanium, gold, combinations thereof, or other suitably conductive material. By way of particular example, hanger bar 202 is formed of copper.

Bar 202 may be shaped as desired, such as substantially straight bar, or, as illustrated, a steer-horn configuration with a rectangular cross section. The various configurations may include multi-angled configurations, off-set configurations, combinations thereof, and the like, having a suitable cross section. In the illustrated example, bar 202 has an asymmetrical shape—a first end 218 extends a shorter distance from perimeter bar 206 compared to a second end 220 and bar 208—which may facilitate use of assembly 200 in a multi-cell electrowinning system.

Center conductor bars 204 may similarly be formed of any suitable conductive material. For example, bars 204 may be formed of copper, copper alloy, aluminum, copper aluminum alloys, stainless steel, titanium, gold, or combinations of such materials.

Bars 204 may suitably include a substrate that is coated with one or more materials. The substrate may include a conductive substrate, formed of, for example, conductive metal, alloy, polymer, and/or material, such as, for example, but not limited to, copper, copper alloys, aluminum, copper aluminum alloys, stainless steel, titanium, palladium, platinum, gold, valve metals or any other metal alloy, conductive polymer, or conductive material, or combinations of such materials that are coated with, for example, a "valve" metal, such as titanium, tantalum, zirconium, or niobium. The valve metals (e.g., titanium) may be alloyed with nickel, cobalt, iron, manganese, or copper to form a suitable conductive cladding layer. By way of particular example, center bars 204 include a copper round bar center that is clad with titanium.

Bars 204 may also have any suitable configuration, such as structures having a round, hexagonal, square, rectangular, octagonal, oval, elliptical, rhombus, or other geometry (e.g., cross section), and may be solid, have a hollow center, and/or include holes through the bar.

A number of bars 204 may be selected based on a variety of factors, such as weight of active surface(s) 216 and desired electrical characteristics of assembly 200. By way of examples, assembly 200 may include 0, 1, 2, 3, 4, 5, 6, 8, 10, or any suitable number of center bars 204.

Bars 204 may be coupled (mechanically and/or electrically) to hanger bar 202 in a variety of ways. For example, bars 204 may be welded to hanger bar 202. Additionally and/or alternatively, hanger bar 202 may include recesses or holes for receiving bars 204, such that bars 204 are press fit into hanger bar 202. A conductive adhesive may also be used to couple hanger bar 202 and center bars 204.

Perimeter bars 206, 208 may be formed of any of the materials described above in connection with center bars 204 and may include any desired configuration, such as those described above in connection with bars 204. By way of one example, perimeter bars 206, 208 are cylindrical and are formed of the same material as bars 204—e.g., a titanium clad copper cylindrical rod. As illustrated, bars 206, 208 may include a bend, generally illustrated as 222 and 224 respectfully, to allow bars 206, 208 to attach to a straight portion of hanger bar 202 at an area interior to an edge of active surface 216.

Similarly, base bar 210 may be formed of the same or similar materials described above in connection with center conductor bars 204 and first and second perimeter bars 206, 208. And, base bar 210 may be connected to one or more of the center connector bars 204 and/or perimeter bars 206, 208 using any of the techniques described above.

In accordance with exemplary embodiments of the invention, base bar 210 is formed of a solid titanium rod. In accordance with further embodiments, bar 210 is coupled to one or more center bars 204 by welding base bar 210 to a centerline of one or more center bars 204 and/or perimeter bars 206, 208.

Figure 3:
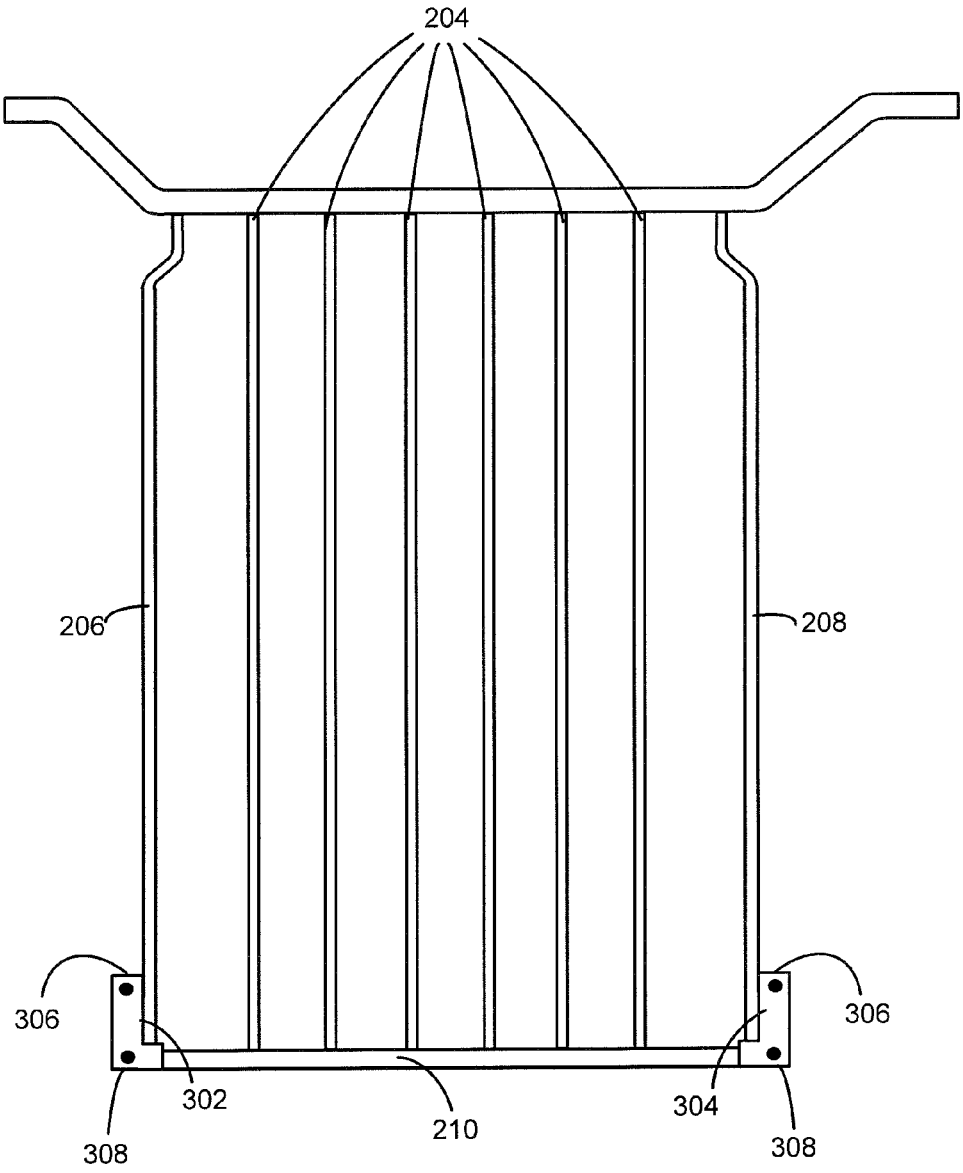
FIG. 3 illustrates a portion of an anode assembly in accordance with various embodiments of the invention.

Referring momentarily to FIG. 3, which illustrates a portion of assembly 200, without active surface(s) 216 and without insulating separators 212, 214, in accordance with additional embodiments of the invention, bar 210 is coupled to perimeter bars 206, 208 via tabs 302, 304. In accordance with these embodiments, first portions 306 of tabs 302, 304 are coupled to respective perimeter bars 206, 208 (e.g., by welding), and second portions 308 of tabs 302, 304 are coupled to bar 210 (e.g., by welding tabs 302, 304 to bar 210). Although illustrated as coupled to an exterior portion of bars 206, 208, in accordance with alternative embodiments of the invention, tabs 302, 304 may be coupled to an interior surface of bars 206, 208 and/or to an interior surface of base bar 210. Tabs 302, 304 may be formed of any suitable material—such as the material used to form bars 204-210. By way of particular example, tabs 302, 304 are formed of titanium.

FIG. 6 illustrates a portion 600 of assembly 200 in accordance with additional embodiments of the invention. Assembly portion 600 is similar to the assembly illustrated in FIG. 3, except base bar 210 is extended and perimeter bars 206 (not illustrated in FIG. 6), 208 are shortened, relative to the same bars illustrated in FIG. 3, and tabs (e.g., illustrated tab 304) are configured or shaped accordingly to couple perimeter bars (e.g., bar 208) to base bar 210. The tabs and bars in accordance with these embodiments may be coupled together using the techniques described above in connection with the embodiments illustrated in FIG. 3.

Referring back to FIG. 2, active substrate 216 may include one or more sheets (e.g., 2 sheets—one each side of bars 204) of active anode material. Substrate 216 material may include any of the materials described above in connection with bars 204, 206, 208, and 210. For example, substrate 216 may be formed of a valve metal, a combination of valve metals, or an alloy comprising a valve metal. In accordance with particular exemplary embodiments of the invention, active substrate is formed of titanium.

In accordance with additional exemplary embodiments, substrate 216 may include a coating, e.g., an electrically active coating on the surface of substrate 216. Exemplary coatings for substrate 216 include platinum, ruthenium, iridium, or other Group VIII metals, Group VIII metal oxides, or compounds comprising Group VIII metals, and oxides and compounds of titanium, molybdenum, tantalum, and/or mixtures, alloys and combinations thereof. By way of one example, substrate 216 includes titanium (e.g., flattened, expanded titanium) coated with a mixture of tantalum oxide and iridium oxide.

Substrate 216 may include a plurality of openings to allow fluid to flow though the anode. In this case, substrate 216 may be formed of, for example, a mesh screen (e.g., a woven wire screen having about 100×100 to about 10×10 strands per square inch), a perforated sheet, or expanded metal (which may be formed by, for example, forming slits in a sheet of metal and then pulling the metal from all sides around the perimeter to create an expanded sheet having a plurality of substantially diamond-shape holes through the metal sheet).

Substrate(s) 216 may be coupled to bars 204 and/or perimeter bars 206, 208 using a variety of techniques. For example, substrate 216 may be coupled to any combination of bars 204-208 using welding, adhesive, braided wire, staples, or similar technique.

By way of one example, substrate 216 is coupled to perimeter bars 206, 208 by welding the respective bar to respective edges (or portions thereof) of substrate 216. Welding the perimeter bars to the outside of active surface 216 reduces formation of edge fraying or bending and reduces or eliminates the need for insulating edge strips along a perimeter of surface 216. The reduction of edge fraying or bending reduces a tendency of assemblies 200 to short and thus may reduce required maintenance for the assemblies and systems including the assemblies. In addition, welding substrate 216 to perimeter bars 206, 208 provides additional stiffness to assembly 200 and thus reduces the tendency of assembly 200 to bend. Reducing the tendency to bend allows for closer spacing between assembly 200 and a cathode assembly and allows for more consistent plating of metal on an active area of the cathode assembly and/or more efficient plating of material (e.g., reduced voltage and power requirements for plating an amount of material onto a portion of the cathode assembly).

Referring now to FIG. 2 and FIGS. 4*a*-4*c*, insulating separators 212, 214 facilitate even separation between anode assemblies 200 and adjacent cathode assemblies, which in turn allows for a reduced spacing between anode assembly 200 and a cathode assembly and more even and/or efficient plating on the active area of the cathode assembly.

Insulating separators 214, 214 may be formed of a variety of materials, such as plastic or ceramic materials. In accordance with various embodiments, insulating separators 214, 214 are formed of plastic, such as polyethylene, polypropylene, PVC, polycarbonate, or the like.

Referring now to FIGS. 2-3 and 4*a*-4*c*, in accordance with exemplary embodiments of the invention, insulating separators 212, 214 are removably coupled to tabs 302, 304 using a suitable fastener, such as a nut and bolt, screws, rivets, twisted wire, or the like. In accordance with various exemplary embodiments of the invention, insulating separators 212, 214 include at least one bracket or brace to couple to tabs 302, 304. In the illustrated example, insulating separators 212, 214 include a u-shape bracket 402 and brackets 404, 406. U-shaped bracket 402 is configured to receive a bottom portion of a respective tab 302, 304 and brackets 404, 406 couple to a second section of respective tab 302, 304.

In accordance with additional embodiments of the invention, insulating separators 212, 214 include a tapered body, such that a lower portion 408 of insulating separators 212, 214 is wider than a top portion 410 of insulating separators 212, 214.

Optional insulators 226, illustrated in FIG. 2, may be formed of any suitable insulating material such as plastic or ceramic materials. In accordance with various embodiments, insulators 226 are formed of plastic, such as polyethylene, polypropylene, PVC, polycarbonate, or the like. Insulators 226 are configured to reduce any short circuits to active surface 216.

Assemblies 200 may include any suitable number of insulators 226, such as 0, 1, 2, 3, 4, 5, 6, or the like. Insulators 226 may be coupled to surface 216 and/or rods 204, 206, 208 using any suitable technique, such as using a suitable fastener, such as an adhesive, a nut and bolt, screws, rivets, twisted wire, or the like.

FIG. 5 illustrates a cut-away view of an electrolytic cell or system 500, including anode assembly 200, in accordance with additional embodiments of the invention. System 500 includes a cathode assembly 502, anode assembly 200, a tank 504, bus bars 506, 508 to couple to cathode assembly 502, and bus bars 510, 512 to couple to anode assembly 200.

During operation of system 500, material is plated onto an active surface of cathode assembly 502 by applying power to bus bars 506-508 and 510-510 to cause current to flow from anode assembly 200 to cathode assembly 502 and to cause metal to deposit onto the active area of cathode assembly 502.

The present invention has been described above with reference to a number of exemplary embodiments and examples. It should be appreciated that the particular embodiments shown and described herein are illustrative of the invention and its best mode and are not intended to limit in any way the scope of the invention as set forth in the claims. It will be recognized that changes and modifications may be made to the exemplary embodiments without departing from the scope of the present invention. These and other changes or modifications are intended to be included within the scope of the present invention, as expressed in the following claims.

The invention claimed is:

1. An anode assembly comprising:

a hanger bar comprising a first end and a second end, wherein the hanger bar comprises an anode conductive material;

a first perimeter bar coupled to the hanger bar at a position interior to the first end and having a first bend; and a second perimeter bar coupled to the hanger bar at a position interior to the second end and having a second bend; and a conductor bar coupled to the hanger bar;

wherein the conductor bar is between the first perimeter bar and the second perimeter bar;

wherein the first perimeter bar and the second perimeter bar comprise copper clad with titanium.

2. The anode assembly of claim 1, further comprising:

an active surface having a first edge and a second edge;

wherein at least a portion of the first edge is coupled to the first perimeter bar and at least a portion of the second edge is coupled to the second perimeter bar.

3. The anode assembly of claim 2, further comprising a first tab coupled to the first perimeter bar and a second tab coupled to the second perimeter bar.

4. The anode assembly of claim 3, further comprising a first insulating spacer coupled to the first tab and a second insulating spacer coupled to the second tab.

5. The anode assembly of claim 4, wherein the first insulating spacer comprises a first bracket to couple to a lower portion of the first tab.

6. The anode assembly of claim 4, wherein the first insulating spacer has a tapered shape, which is wider at a bottom of the first insulating spacer and narrower at a top of the first insulating spacer.

7. The anode assembly of claim 1, wherein the first perimeter bar is welded to at least a portion of the first edge and the second perimeter bar is welded to at least a portion of the second edge.

8. The anode assembly of claim 2, wherein the active surface comprises expanded titanium.

9. An anode assembly comprising:

a hanger bar comprising a first end and a second end;

a first perimeter bar coupled to the hanger bar at a position interior to the first end and having a first bend;

a second perimeter bar coupled to the hanger bar at a position interior to the second end and having a second bend; and a base bar coupled to a first tab and a second tab; and a conductor bar coupled to the hanger bar and the base bar;

wherein the conductor bar is between the first perimeter bar and the second perimeter bar; and wherein the first perimeter bar and the second perimeter bar comprise copper clad with titanium.

10. The anode assembly of claim 9, wherein the first tab is coupled to the first perimeter bar;

wherein the second tab is coupled to the second perimeter bar; and wherein the first tab and the second tab comprise a metal.

11. The anode assembly of claim 10, further comprising a first insulating separator coupled to the first tab and a second insulating separator coupled to the second tab.

12. The anode assembly of claim 10, wherein the first perimeter bar and the second perimeter bar comprise a metal core and a cladding layer.

13. The anode assembly of claim 12, wherein the first perimeter bar and the second perimeter bar comprise copper clad with titanium.

14. The anode assembly of claim 10, further comprising a first active area coupled to the first perimeter bar and the second perimeter bar.

15. The anode assembly of claim 14, wherein the first active area comprises expanded titanium.

16. The anode assembly of claim 14, wherein the first active area comprises expanded titanium coated with a mixture of tantalum oxide and iridium oxide.

17. The anode assembly of claim 14, further comprising a second active area coupled to the first perimeter bar and the second perimeter bar.

18. The anode assembly of claim 17, wherein the second active area comprises expanded titanium.

* * * * *